United States Patent [19]

Staaf

[11] 4,092,013

[45] May 30, 1978

[54] MIXER WITH NO MOVING PARTS

[76] Inventor: Gustaf Adolf Staaf, Navigatorgatan 6, Vasteras, Sweden

[21] Appl. No.: 602,249

[22] Filed: Aug. 6, 1975

[30] Foreign Application Priority Data

July 9, 1975 Sweden ..... 7411581

[51] Int. Cl.[2] ..... B01F 5/00

[52] U.S. Cl. ..... 366/165; 366/177; 366/336

[58] Field of Search ..... 259/4, 18–19, 259/36–37, 96, 60–61; 34/181; 138/40–43, 46; 261/79

[56] References Cited

U.S. PATENT DOCUMENTS

| | | | |
|---|---|---|---|
| 1,842,877 | 1/1932 | Muller | 259/4 R |
| 2,566,555 | 9/1951 | Coultes | 259/96 |
| 2,653,801 | 9/1953 | Fontein | 259/4 R |
| 3,215,407 | 11/1965 | Dye | 259/60 |
| 3,261,593 | 7/1966 | Sharples | 259/4 R |
| 3,363,403 | 1/1968 | Vicard | 261/79 A |
| 3,566,582 | 3/1971 | Yankura | 261/79 A |
| 3,779,518 | 12/1973 | Koepke | 259/60 |

FOREIGN PATENT DOCUMENTS

| | | | |
|---|---|---|---|
| 1,094,231 | 5/1955 | France | 259/4 R |

*Primary Examiner*—Harvey C. Hornsby
*Assistant Examiner*—Robert Pous
*Attorney, Agent, or Firm*—George H. Mitchell, Jr.

[57] ABSTRACT

A mixing device for combining two or more components, at least one of which is a fluid, comprises a cylindrical housing having a tangentially arranged tubular inlet for a liquid, a second inlet for another component to be mixed with the fluid, and a centrally located axially extending tubular outlet provided with a baffle plate which, by creating turbulence in the flow, assists in the mixing process.

10 Claims, 16 Drawing Figures

MIXER WITH NO MOVING PARTS

The present invention relates to a device for mixing two or more components, at least one of which is comprised in a fluid flow, continuously supplied to the device through a tubing or tubings connected thereto. The other components to be mixed may be in the form of fluid flows, gases, or even solids in particle state. The device according to the invention is more generally referred to as "mixer".

Mixers are previously known, which comprise one or more driven mechanical stirrer, responsible to the mixing action. The object of the present invention is to provide a simplified mixer, with no moving parts but still effectively working.

A mixer according to the present invention comprises a housing, designed as a solid of revolution, two or more tubings connected thereto for supplying to the housing the different components to be mixed, of which tubings at least one is tangentially connected to the housing, and an outflow tubing axially connected to the housing and containing a number of flow obstructions. The flow or flows which at suitable velocities are tangentially fed into the housing are forced to a directional change into a spiral or vortex-like flow, the rotational rate of which is increasing towards the center, in order that the flow, when leaving the housing through the centrally connected outflow tubing, has achieved a screwed rotational motion, which is abruptly hindered by the obstructions arranged in the outflow tube, so that a strong turbulence is generated, resulting in an intimate mixing of the components.

The suitable velocity for introducing into the housing the tangentially supplied mixture component may be determined by experiments.

The invention will now be further explained with reference to the attached drawings.

Figure 1:
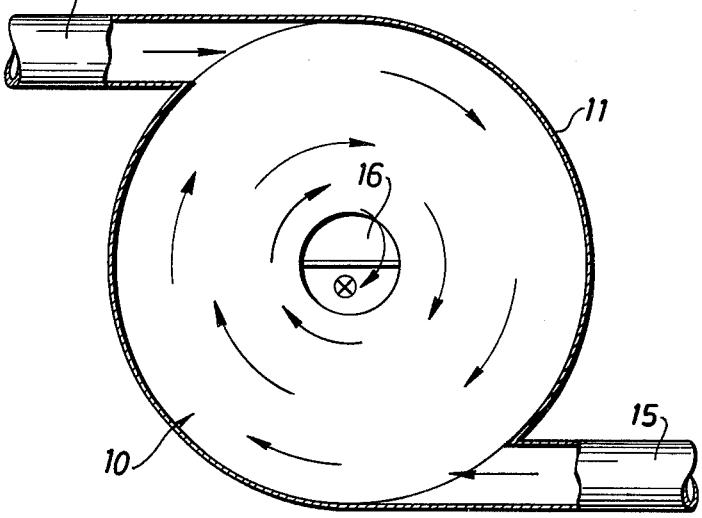
FIGS. 1 and 2 show a lateral view and an axial section respectively of a mixing device for two components, both of which are supplied to the housing tangentially.
Figure 2:
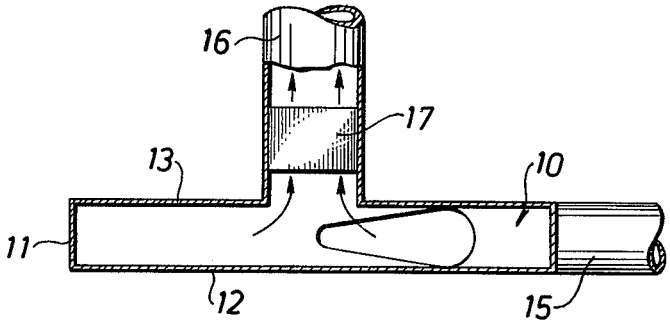

The mixing device of FIGS. 1 and 2 consist of a housing 10 designed as a solid of revolution having a circular cylindrical casing 11 and two plane gables 12 and 13.

Tangentially to the casing 11 are connected two tubings 14 and 15 and to the center of one gable perpendicular thereto is connected an outflow tubing 16. In the mouth of the outflow tubing there is arranged an obstruction designed as a plane plate 17, the plane of which coincides with diametrical plane in the tubing.

The mixing device works in the following way.

Two fluids to be mutually mixed are introduced at a suitable flow velocity tangentially into the housing 10 through the tubings 14 and 15. The tangentially directed fluid flows from the tubings are in the housing 10 deflected into a spiralized flow towards the center of the housing. The rotational velocity for each imagined spiral turn is increasing when the center is approached, in order that the fluid is leaving the housing through the tubing 16 at a rapidly rotating motion with its rotational axis coinciding with the longitudinal axis of the tubing. This rapidly rotating motion of the fluid flow is abruptly hindered by the plate 17 and the resulting turbulence will bring about the intimate mixing of the two components.

As is easily appreciated the revolutional velocity and the rotational velocity respectively of the fluid flow leaving the housing 10 through the tubing 16 is related to the revolutional velocity of the components to be mixed at the cylindrical casing of the housing, as the diameter of the housing to the diameter of the outflow tubing. At the embodiment of FIGS. 1 and 2 the relation of these dimensions amount to about 5:1. If the diameter of the housing is for instance 10 cm the diameter of the outflow tube is 2 cm. If the inflow velocity of the fluid flows through the tangentially connected tubings 14 and 15 are chosen to 0,3 m/sec., the rotational velocity of the fluid in the housing at the cylindrical casing will be about 1 turns/sec., and the rotational velocity of the fluid flow leaving the housing through the outflow tubing will be about 5 turns/sec. The velocity at which the components to be mixed are pressed tangentially into the housing, is chosen as higher as more difficult it would be to mix the components, but with respect to increasing pressure drop in the mixing device said velocity should not be chosen greater than necessary in each single case.

Figure 3:
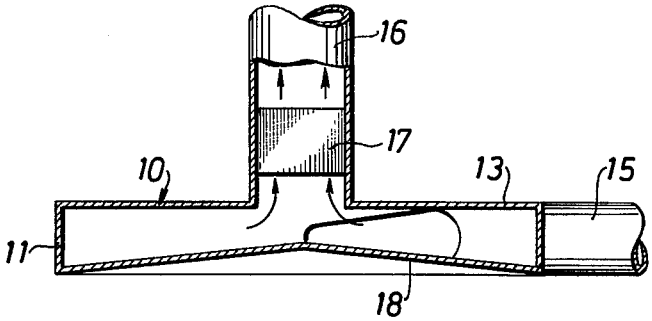
FIG. 3 shows the central portion only of an axial section of a mixing device similar to that of FIGS. 1 and 2, but having its gable opposite to the outflow tube designed as a cone.

In the embodiment shown in FIG. 3 the gable 18 of the housing 10, opposite to the outflow tubing 16 is concavely cone shaped. The design of the gable brings about that the flow area in each imagined spiral turn is decreasing when the center of the housing is approached. Thus, the flow velocity in the spiral is increasing when the center is approached, resulting in that the revolutional and rotational velocity respectively of the fluid flow out through the outflow tubing 16 is further increased.

Figure 4:
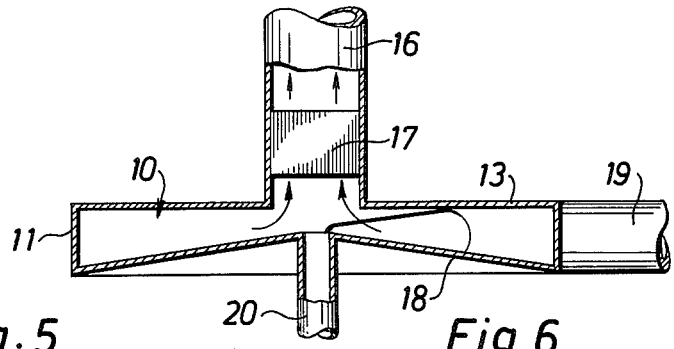
FIG. 4 shows an axial section of a mixing device similar to that of FIG. 3, but having the supply tube for one of the components to be mixed arranged centrally through the conical gable.

In the embodiment shown in FIG. 4 only one tubing 19 of the two supplied tubings is tangentially connected to the cylindrical housing 10, while the supply tubing for the other component to be mixed, denoted in the drawing by 20, is connected to the center of the conical gable 18. The tubing 20 has far smaller diameter than the tubing 19. This embodiment of the present invention is suitable for instance when the amount supplied per time unit of one of the components to be mixed is small as compared to the amount supplied per time unit of the other component.

The embodiment according to FIG. 4 is particularly suitable when a thermical reaction takes part at the mixing of two components. Since the heat of reaction is not evolved until in the mixing zone of the outflow tubing 16 at or after the hindering plate 17, a temperature rise in the housing is avoided, in order that for instance heat isolation of the housing will be unnecessary. If the mixing and reaction product respectively is strongly corrosive and requires high-quality material in the mixing zone, a simpler material could be used for the housing.

One example of this problem is the dilution of hydrochloric acid with water. In this case the water is supplied to the cylindrical housing tangentially through the tubing 19, and hence the housing 10 could be made of a material which is resistant to water corrosion, while only the outflow tubing 16 and the hindering plate 17 arranged in it have to be made from a material which is resistant to corrosion from the diluted acid.

Figure 5:
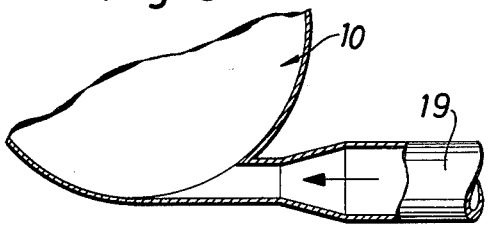
FIGS. 5 and 6 show modified designs of the mouth part of a tubing for tangentially supplying a component to be mixed.
Figure 6:
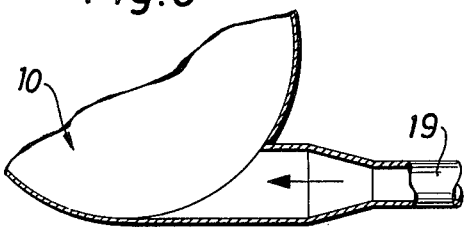

FIG. 5 shows how the inflow velocity of the tangentially supplied mixture component could be increased over the flow velocity in the supply tubing by designing with a conical restriction at or near the inflow end of the tubing into the housing. In contrast, according to FIG. 6, the flow velocity could be decreased by designing the tubing to have a conical dilation at or near the inflow into the housing 10.

Figure 7:
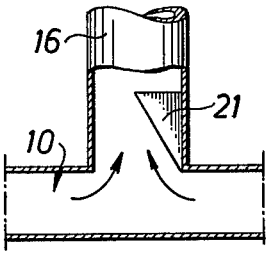
FIGS. 7 and 8 show modified designs of the flow obstruction in the outflow tube.
Figure 8:
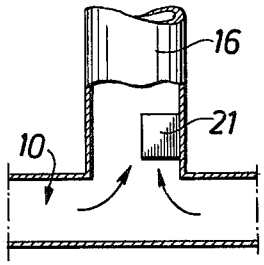

FIGS. 7 and 8 show different designs of the obstruction means 21 in the outflow tubing 16 of the mixing device.

Figure 9:
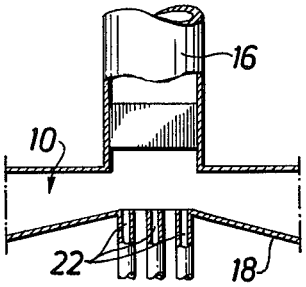
FIG. 9 shows a mixing device having three centrally connected supply tubings for components to be mixed.

In the embodiment according to FIG. 9 supply tubing 22 for three of the components have been connected to the housing through the gable of the mixer housing at its center.

Figure 10:
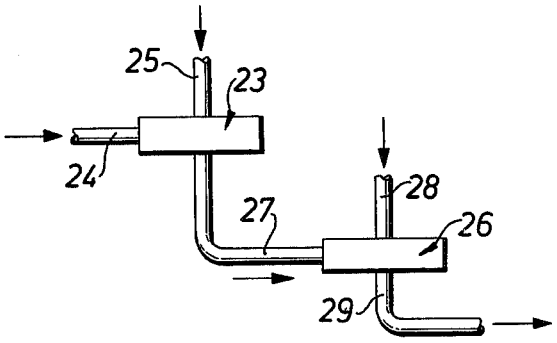
FIGS. 10 and 11 show different ways of series connection of two mixing devices.

FIG. 10 shows two mixing devices according to FIG. 4 connected in series. This connection is suitable, when two relatively small components, which would not be allowed to be supplied simultaneously should be added to a relatively large flow. The large flow is supplied to the mixing device 23 tangentially through the entrance 24.

The first smaller flow is supplied to the mixing device 23 through the central supply tubing 25. The mixing product from the outflow of the mixing device 23 is supplied to the mixing device 26 through its tangential supply 27. The second small flow is supplied to the mixing device 26 through the central supply 28. The mixture of three components will leave the system through the outflow 29 from the mixing device 26.

Figure 11:
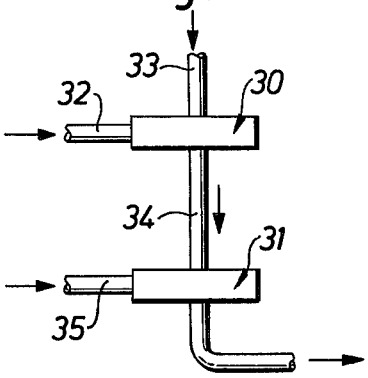

In the series connection as shown in FIG. 11 of the two mixing devices 30 and 31 respectively, the mixing product of the flow components, which have been supplied to the mixing device 30 through supply tubings 32 and 33, are supplied to the mixing device 31 centrally through the supply 34. The mixing product from the mixing device 30 is mixed in the mixing device 31 with a flow which is supplied through the tangential supply tubing 35.

Figure 12:
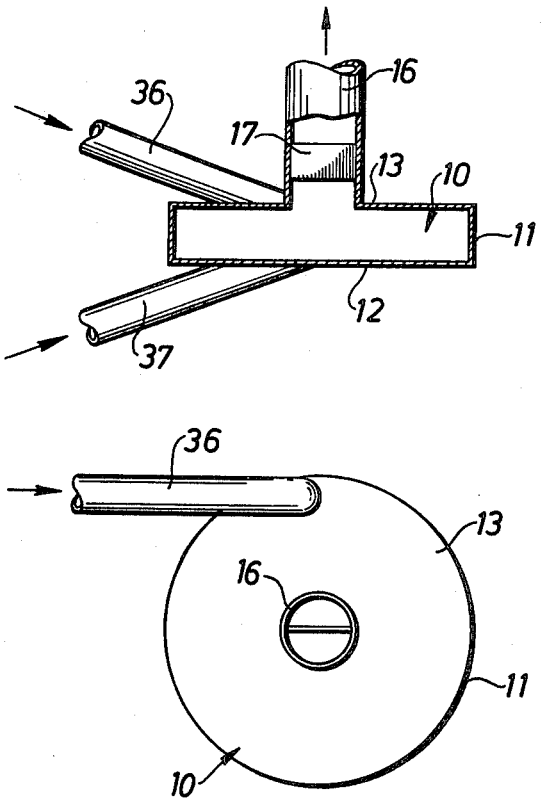
FIG. 12 shows a mixing device, in which two supply tubings, which are essentially tangentially directed, are connected to the two gables of the housing.

In the embodiment according to FIG. 12 two essentially tangentially directed supply tubings 36 and 37 are connected at suitable angles to the gables 12 and 13 of the housing.

Figure 13:
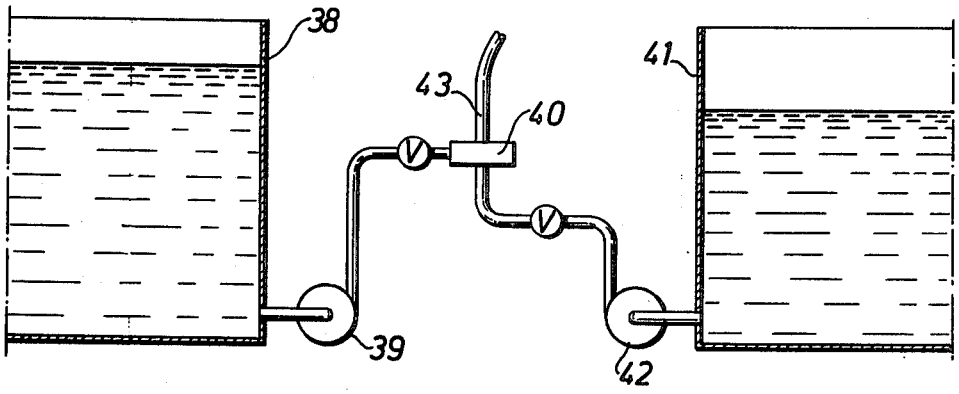
FIG. 13 shows schematically a complete system for mixing of two components.

FIG. 13 shows in principle the design of a system for mixing of two components. From a container 38 one component is transported by means of a pump 39 tangentially to a mixing device 40. From the container 41 a second component is pumped by means of a pump 42 centrally to the mixing device. The mixing product leaves the system through the central outflow 43 of the mixing device 40.

Figure 14:
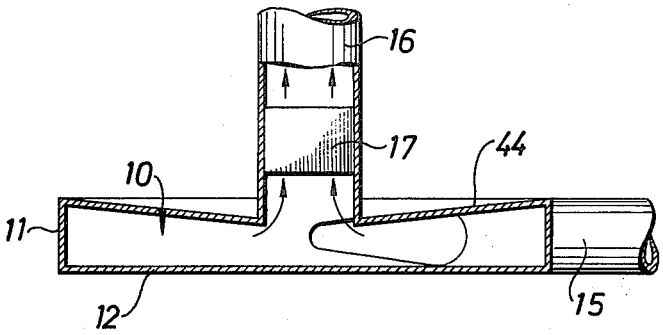
FIGS. 14 – 16 show further embodiments of the mixing device according to the invention.

FIG. 14 shows a mixing device similar to that of FIG. 2. In the embodiment of FIG. 14 the gable 12 of the housing 12 is plane, while the gable 44 on the same side of the housing as the outflow 16 is concavely cone shaped. All other numbers refer to the same features as in FIG. 2.

Figure 15:
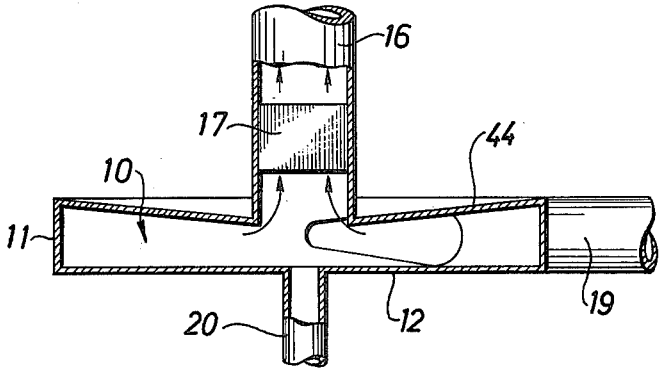

FIG. 15 shows a device similar to that of FIG. 4. The gable 12 opposite to the outflow 16 is plane, while the gable 44 on the same side as the outflow is concavely cone shaped. All other numbers refer to the same as in FIG. 4.

Figure 16:
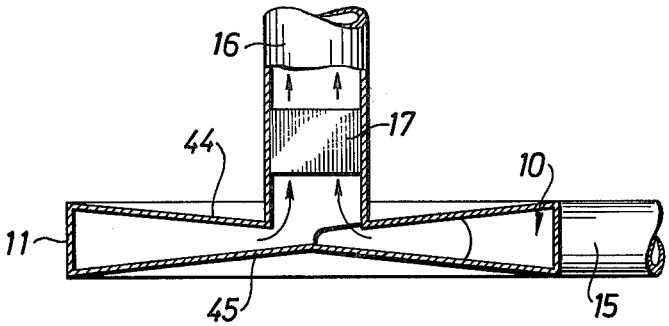

The embodiment of FIG. 16 is similar to that of FIG. 14. Both gables 44 and 45 are concavely cone shaped.

Thus, in the mixing devices of FIGS. 2 and 3 as well as those of FIGS. 14 – 16 the flow area in each imagined spiral turn is decreasing when the center is approached. The flow velocity in the spiral is increasing when the center is approached, resulting in that the revolutional and rotational velocities respectively of the fluid flow out through the outflow tubing 16 is further increased. More generally described, the section in the plane of the symmetry axis of said housing is narrowing from the periphery towards the symmetry axis of said housing. Of course this may be achieved alternatively by one concavely cone shaped gable and one convexely cone shaped gable, provided the axial dimension of the housing is decreasing from its periphery to its center. Other designs than cones are also conceivable. Mixing devices having a section in the plane of the symmetry axis of the housing, which is narrowing from the periphery towards the symmetry axis will represent preferred embodiments of the present invention.

The mixers in FIGS. 4, 9 and 15 are provided with supply tubings 20, 22 connected to the center of the gable 12, 18 opposite to the outflow tube 16. Through these tubings fluid components may be supplied, for example for reasons discussed above. Also gaseous components and even solid in particle state may be added by means of such tubings. Components fed by tubings tangentially connected to the housing 10 should be in fluid state.

I claim:

1. A mixing device comprising a housing defined by a surface of revolution having a central axis with a peripheral wall concentric with said axis, and two axially spaced generally radial gables, at least two inlet tubings connected with said housing for supplying different components to the housing to be mixed, a single outflow tubing connected to said housing at said central axis for withdrawing mixed components, at least one of said inlet tubings being joined to the housing tangentially to said peripheral wall to induce a spiral inwardly directed flow in said housing, the axial length of said housing being relatively narrow compared to its diameter to confine the spiral inwardly directed flow of the components to a radial direction, the axial cross-section of the housing becoming narrower in the direction from peripheral wall to the axis so as to increase the rate of said spiral flow as the components approach the outflow tubing, said outflow tubing being provided with a flow obstruction comprising a hindering plate in a position transverse to the circumferential component of rotational motion of the outflowing medium.

2. Mixing device according to claim 1, characterized in that said housing exhibits one plane gable and one concavely cone shaped gable.

3. Mixing device according to claim 1, characterized in that said housing exhibits two concavely cone shaped gables.

4. Mixing device according to claim 1, characterized in that at least one supply tubing is centrally connected to the housing through the gable opposite to the outflow tubing.

5. Mixing device according to claim 4, characterized in that one or more of said supply tubings are provided with a conical restriction at or near the inflow end into the housing of said tubing or tubings.

6. Mixing device according to claim 1, characterized in that one or more of said supply tubings are provided with a conical dilation at or near the inflow end into the housing of said tubing or tubings.

7. System for mixing two or more components, comprising at least two mixing devices according to claim 1, and tubing means for communication between the outflow tubing of one of said mixing devices and the interior of the housing of another of the mixing devices.

8. System according to claim 7, further comprising one or more pumps and tubing for communication between a pump and said mixing devices for transferring components from one mixing device to another 9. System for mixing two or more components, comprising at least two mixing devices according to claim 1, and tubing means for communication between the outflow tubing of one of said mixing devices and the interior of the housing of another of the mixing devices.

10. System according to claim 9, further comprising one or more pumps, and tubing for communication between a pump and said mixing devices for transferring components from one mixing device to another.

* * * * *

UNITED STATES PATENT OFFICE

CERTIFICATE OF CORRECTION

Patent No. 4,092,013 Dated May 30, 1978

Inventor(s) Gustaf Adolf Staaf

It is certified that error appears in the above-identified patent and that said Letters Patent are hereby corrected as shown below:

On the cover sheet Item (30) Foreign Priority Data should read:

Sweden 7411581 September 13, 1974 --.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*